US005299949A

United States Patent [19]

Fortin

[11] Patent Number: 5,299,949

[45] Date of Patent: Apr. 5, 1994

[54] ELECTRICAL CONNECTOR WITH SEALING GROMMET

[75] Inventor: Hugues Fortin, Wintzenheim, France

[73] Assignee: Francelco, Suresnes, France

[21] Appl. No.: 940,893

[22] PCT Filed: Feb. 13, 1992

[86] PCT No.: PCT/FR92/00139

§ 371 Date: Dec. 14, 1992

§ 102(e) Date: Dec. 14, 1992

[87] PCT Pub. No.: WO92/15133

PCT Pub. Date: Sep. 3, 1992

[30] Foreign Application Priority Data

Feb. 15, 1991 [FR] France ..... 91 01821

Feb. 15, 1991 [FR] France ..... 91 01822

[51] Int. Cl.[5] ..... H01R 13/52

[52] U.S. Cl. ..... 439/275; 439/589

[58] Field of Search ..... 439/587, 589, 274, 275

[56] References Cited

U.S. PATENT DOCUMENTS 4,460,227 7/1984 Ball ..... 439/271

4,662,692 5/1987 Uken et al. ..... 439/426

4,874,325 10/1989 Bensing et al. ..... 439/272

4,932,875 6/1990 Ogawa et al. ..... 439/271

FOREIGN PATENT DOCUMENTS 0335721 3/1989 European Pat. Off. .

2602374 2/1988 France .

2168548 6/1986 United Kingdom .

*Primary Examiner*—Gary F. Paumen

*Attorney, Agent, or Firm*—Pollock, Vande Sande & Priddy

[57] ABSTRACT

The electrical connector suitable for use in the automobile industry comprises an insulating body (12) pierced by passages for receiving contacts each provided with a connection wire (18), and comprising a rear feedthrough (36) made of elastomer material, pierced by at least two rows of individual passages for the wires, and held by a perforated plate that is removably fastenable to the body. Each passage through the feedthrough includes at least one sealing lip whose rest shape is such that it closes the corresponding individual passage in the absence of a wire when the feedthrough is held by the perforated plate.

11 Claims, 8 Drawing Sheets

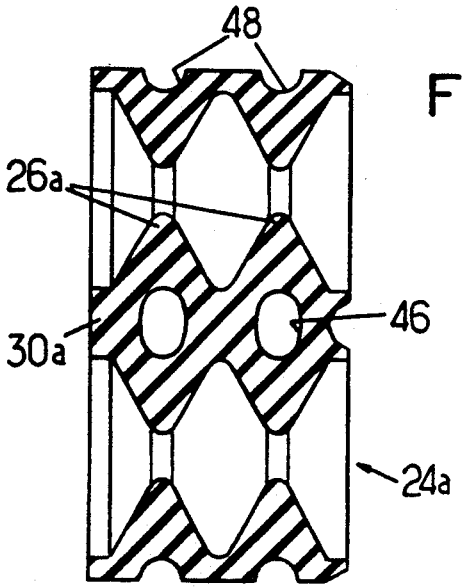
FIG. 6.
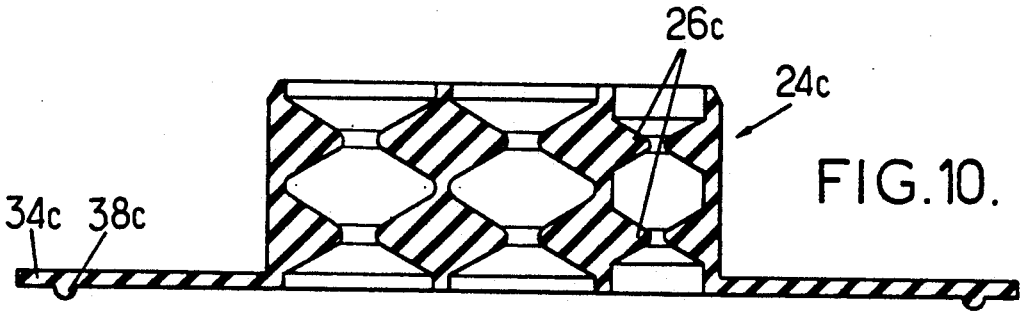
FIG. 10.
FIG. 9.
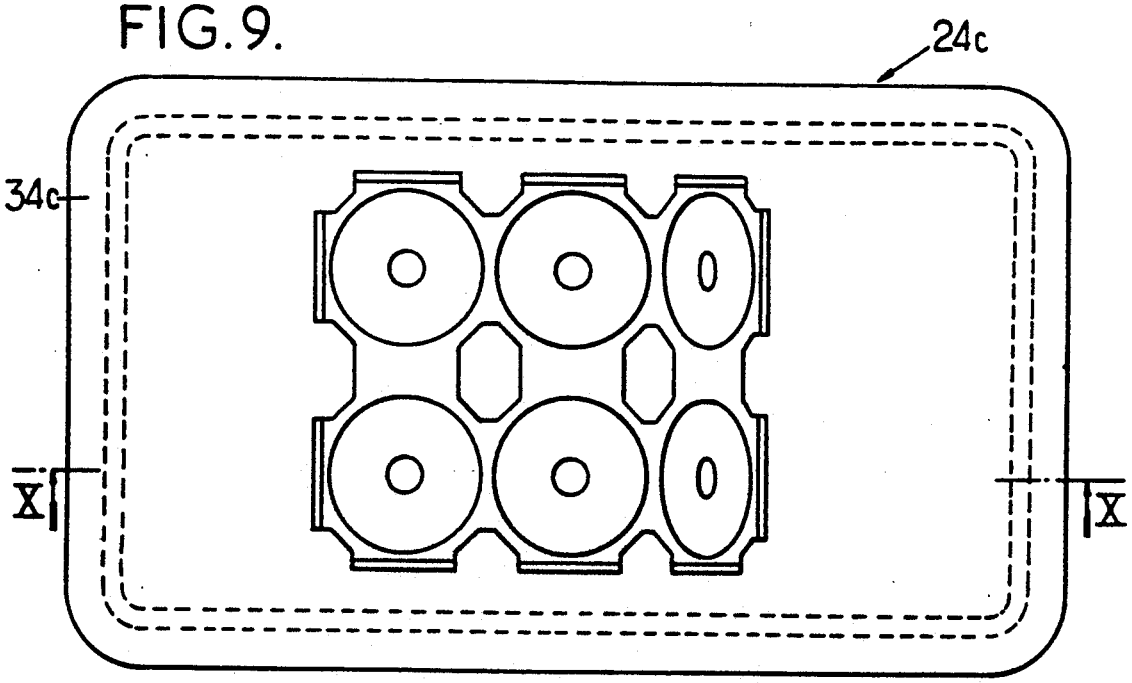

ELECTRICAL CONNECTOR WITH SEALING GROMMET

BACKGROUND OF THE INVENTION

The present invention relates to electrical connectors of the type comprising an insulating body formed with passages for receiving contacts each provided with a connection wire, and for receiving a rear grommet or feedthrough made of elastomer material formed with at least one row of passages for individual wires (and generally with at least two parallel rows) and held by a plate that is removably fastenable to the body.

Such connectors are in widespread use at present. Numerous applications, e.g. in the automobile industry, require connectors to be sealed, which means that it must not be possible for a polluting liquid to penetrate between the grommet and either the wires or the insulating body.

A solution that is in widespread use at present for ensuring sealing consists in casting a polymerizable material over the wires behind the grommet or as a replacement for the grommet. That solution suffers from the drawback of making the connector unsuitable for disassembly. A solution that allows a contact provided with its insulated wire to be removed and replaced consists in providing a circular sealing lip or lips in the wall of each individual passage for the purpose of bearing against a wire. However, in present grommets, sealing is obtained only if the passages are indeed occupied by wires of sufficient diameter. Unfortunately, particularly in the automobile industry, it is desired that the same connectors should be usable over a range of vehicles, with some contact locations not necessarily being occupied in every case.

SUMMARY OF THE INVENTION

It is an object of the present invention to provide an improved electrical connector of the above-defined type particularly in that it simultaneously makes disassembly possible and provides sealing, even when some positions are not fitted with contacts and wires.

To solve this problem, the invention starts from the observation that there now exist contacts having front ends that are not sharp, and that can therefore be inserted in the orifices of a feedthrough whose section at rest is considerably smaller than that of the contact. Particular mention may be made of a female contact of this type as described in Document EP-A-0 310 487 having a front end that includes two sides formed by folds and in which the edges of the other two sides are set back from the folds, thereby avoiding tearing of the feedthrough. Mention may also be made of a male contact comprising blades designed to be inserted in a female contact of the kind described in DocLunent EP-A-0 310 487, which blades have chamfered front ends.

Consequently, the invention provides a connector of the above-defined type characterized in that each passage of the feedthrough includes at least one sealing lip whose rest shape is such that it closes the corresponding individual passage in the absence of a wire when the feedthrough is held by the plate, and in that voids are left in the feedthrough to receive the elastomer pushed back from the zones surrounding the lips when the lips press against a wire.

The invention also provides a connector of the above-defined type, in which the plate is constituted by a rigid part having flanks designed to be laterally inserted on either side of the rows and to push back said elastomer material transversely, and a partition for each gap between two rows, the partition being designed to be inserted in a notch formed in the feedthrough halfway between the two rows, the thickness of the flanks and of the partitions being proportional to the gap between the sealing lips provided in the passages so as to cause the lips to close onto themselves in the absence of wires, voids being left in the feedthrough to receive the elastomer pushed back from the zones surrounding the lips when the lips press against a wire.

The voids reserved in the feedthrough generally include notches or empty zones each formed between two successive passages on either side of the corresponding row, or less frequently, of the single row. When there are several rows, said notches are to be found, in particular, in the center of the rectangle whose corners correspond to the axes of four adjacent passages.

The elastomer material should be chosen to be sufficiently deformable so that the mutual contact between opposing portions of the lips is sealed and so that the material deformed by the presence of a large diameter wire can move towards the voids. In practice, the elastomer will generally have hardness of less than 40 on the Shore scale.

Such a disposition makes it possible to reconcile the apparently contradictory requirements of sealing and of suitability for disassembly: if an increase is required in the pitch at which the contacts are distributed, it is small and in one direction only. In practice, there is no particular difficulty in making connectors in this way having up to six rows of contacts.

When the plate constitutes a flat perforated part, the feedthrough may be designed so that the contacts fitted with their wires are inserted after the feedthrough has been installed in the body, but before the perforated plate has been installed and fixed. Provision may also be made for the contacts to be insertable after the feedthrough and the plate have been installed.

The voids reserved in the feedthrough may be of various different kinds. They may comprise zones between a plurality of successive lips in a single passage. They may also be constituted by recesses within the lips. They may also include notches in the elastomer remaining between the rows and on either side of the rows, in the side wall of the feedthrough.

Sealing between the feedthrough and the body is simple to obtain under all circumstances. It may be provided, conventionally, by pressing the side faces of the feedthrough against the inside face of the body, i.e. by radial pressure. When the plate is constituted by a single perforated flat part, it may be designed to keep the feedthrough under compression that guarantees sealing. When recesses constituting the voids are formed in the side walls of the feedthrough, sealing may be achieved by plane thrust against the body of one or more lips provided on the feedthrough, around the set of passages.

Sealing between the feedthrough and the body may also be obtained by plane thrust against the body of one or more lips provided on the feedthrough, around the set of passages. The lips may be kept under pressure by an end wall of the plate, provided with means for fastening it to the body.

The invention will be better understood on reading the following description of particular embodiments of the invention given as non-limiting examples.

BRIEF DESCRIPTION OF THE DRAWINGS

FIGS. 6 and 7 are similar to FIG. 3 and show variant embodiments of the feedthrough;

FIGS. 9 and 10 are similar to FIG. 2 and a section on X—X, showing yet another variant embodiment;

DETAILED DESCRIPTION OF PREFERRED EMBODIMENTS

Figure 1:
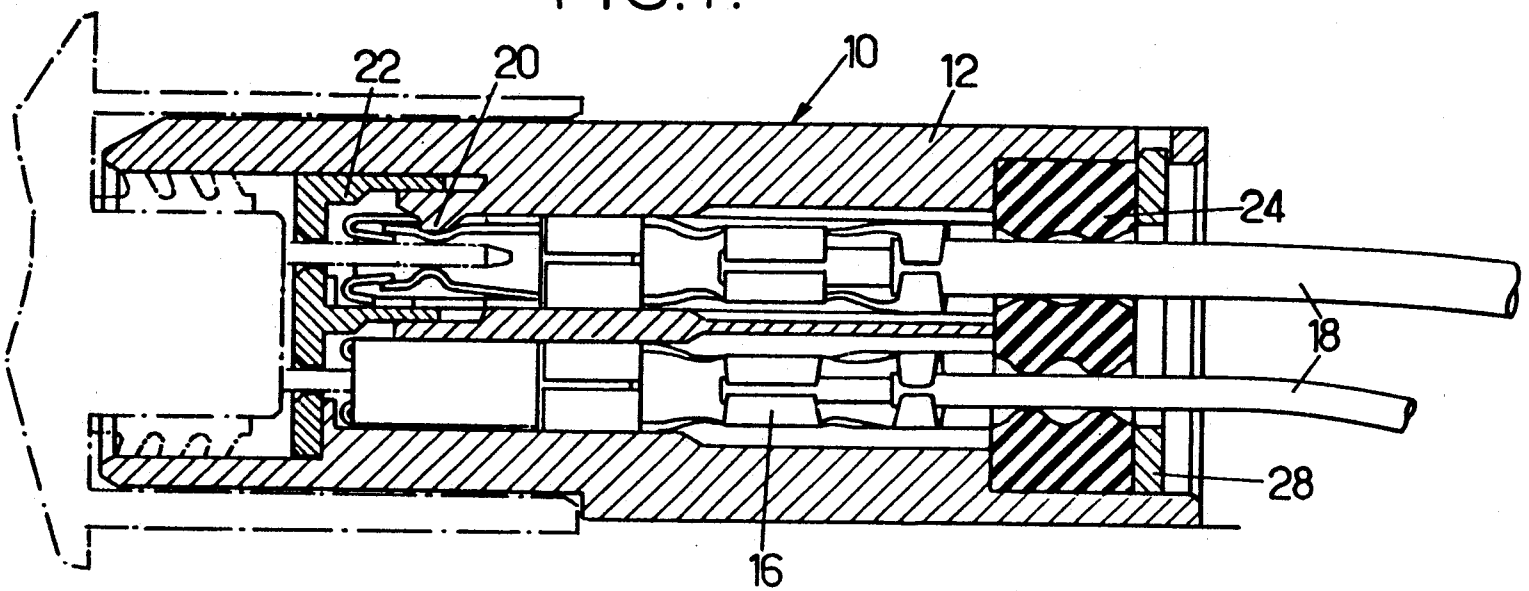
FIG. 1 is a simplified section view of a connector having two rows of contact positions, the section being on a longitudinal plane that is orthogonal to the rows, and the connector being provided with a feedthrough of the invention.

The general structure of the connector shown in FIG. 1 is conventional. It is intended to be coupled to a complementary connector whose terminal portion is drawn in dot-dashed lines.

The connector 10 comprises a body 12 of electrically insulating material pierced by passages 14 for receiving contacts 16 each provided with a connection wire 18. In the example shown in FIG. 1, the body of the connector comprises two rows of passages 14, but this number is not limiting. The passages are designed to receive contacts having front ends that are not sharp, i.e. having no projecting sharp edges. The contacts shown are female contacts having the structure described in Document EP-A-0 310 487. These contacts are in the form of cages and they have windows for receiving retaining lugs 20 carried by respective resilient fingers belonging to the body and held in place by a front locking member 22. The contacts could equally well be of the male type and be constituted by tongues or blades having chamfered front ends, as shown in the lefthand portion of FIG. 1.

The invention is equally applicable to other types of contact and to other types of connector, in particular to connectors in which the insulating body is contained in a shell that is different in kind from the body.

The rear portion of the body in the example shown is thinner than the portion thereof containing the contacts and the connections between the wires 18 and the contacts 16, and it contains a sealing feedthrough 24 pierced by individual passages, each intended to receive a single wire 18, which passages are also disposed in rows, and each of them corresponds to one of the passages in the insulating body.

The feedthrough comprising the embodiment of the invention shown in FIGS. 2 to 5 is suitable for use in particular when the front faces of the contacts are approximately square in shape. It is constituted by a part made by molding a flexible elastomer, generally having a hardness of less than 40 on the Shore scale. Each of the passages for receiving a wire is circularly symmetrical in shape or has a shape whose right cross-section is elongate, and it includes corrugations that constitute lips 26, there being two lips per passage in the example shown. These lips are of height h considerably greater than that used for ordinary feedthroughs for passages at a given pitch. At rest, each lip defines an orifice of diameter d that is small enough to allow the lip to close on itself and provide sealing in the absence of a wire when the feedthrough is deformed by insertion of a rigid rear plate 28 which is described below.

In order to allow wires having a diameter much greater than the rest diameter d of the orifices to be inserted into at least some of the passages, voids are formed in the feedthrough. In the example shown in FIGS. 2 to 4, these voids comprise firstly zones that are set back between the lips 26, and secondly broad notches 32 that are formed in the insulation between successive passages in the same row.

Sealing between the body 12 and the feedthrough 24 may be obtained in various different ways. In the example shown in FIG. 3, it is achieved by plane thrust: the feedthrough 28 includes a circumferential lip 38 (the number one not being limiting) for pressing against a shoulder 36 of the body.

Sealing may equally well be obtained merely by lateral thrust against the feedthrough.

Figure 3:
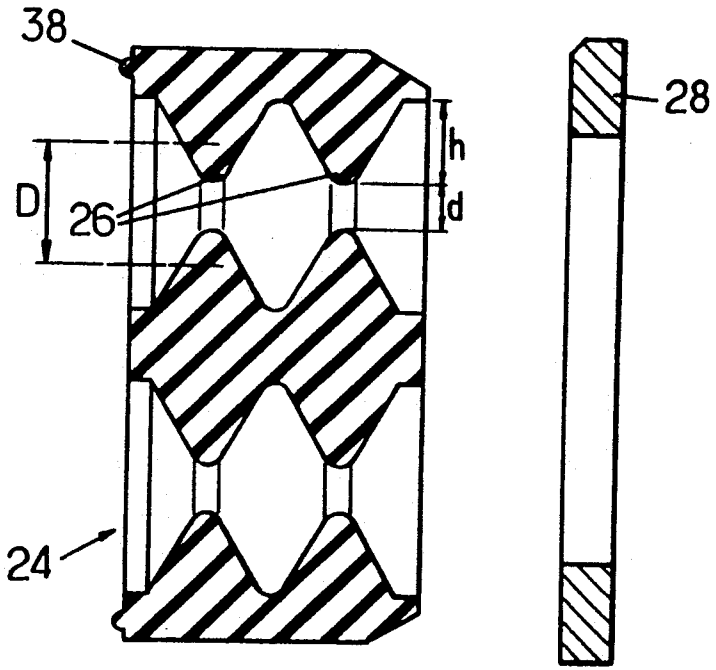
FIG. 3 shows the feedthrough of FIG. 2 and an associated rigid plate in section on the line III—III of FIG. 2.

On its own, a feedthrough having the shape shown in section in FIG. 3 would suffice to guarantee sealing between a feedthrough and wires of diameter not less than d. In contrast, passages not having wires fitted therein would provide access to pollutants. Such passages are closed when a rigid plate 28 for applying axial compression to the feedthrough and for pushing back the lips is inserted in the body 12. The plate 28 is provided with means suitable for fastening it to the body. In the example shown in FIGS. 3 and 5, these means are constituted by one or more lugs 42 that snap-fasten in holes provided in the body. The spacing of the holes is such that when the part 28 is locked, it presses the lip 38 against the shoulder of the body and provides sealing between the body and the feedthrough. This disposition is also such that the elastomer is pushed back and closes the orifices in the absence of wire.

The voids formed in the feedthrough make it possible, when a wire 18 is occupying a passage, for the elastomer to deform by filling the voids, thereby releasing the necessary section, as shown in FIG. 1.

In practice, it is possible, in general, to accept wires having a diameter that is no greater than the half-height diameter D of the lips 26.

The pitch at which the passages are distributed in a given row may be the s&ne as that usually used in feedthroughs having lips. However, it may be preferable to have a slightly larger spacing between the rows.

Figure 2:
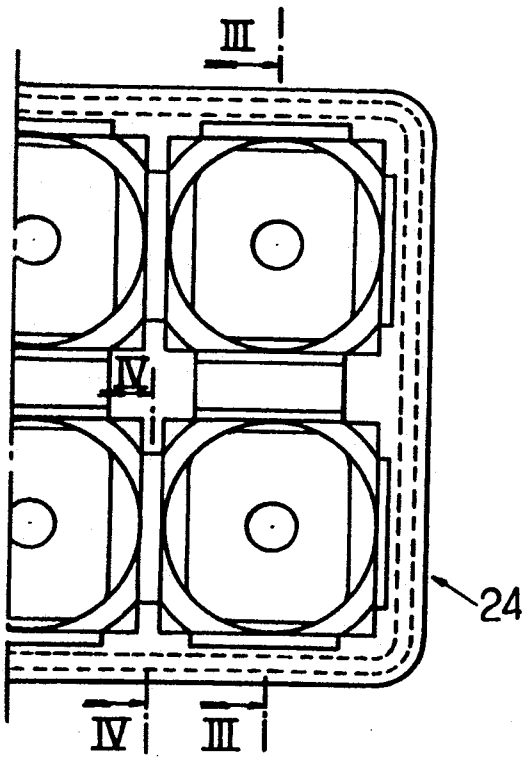
FIG. 2 is a rear view of a feedthrough comprising a particular embodiment of the invention and usable in the connector of FIG. 1, the feedthrough having two rows of passages and being shown in the free state.
Figure 4:
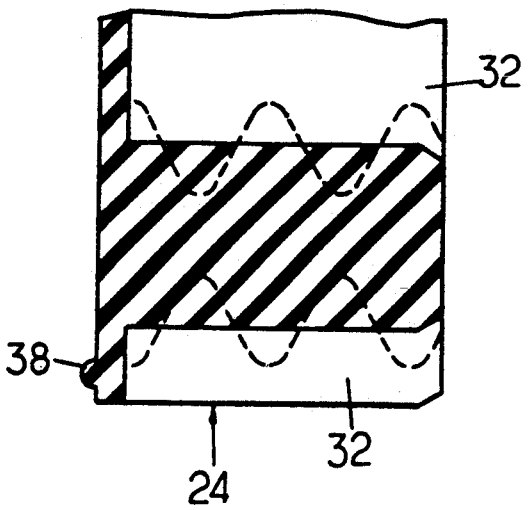
FIG. 4 shows the feedthrough of FIG. 2 in section on line IV—IV of FIG. 2.

For example, it may be mentioned that a feedthrough of the kind shown in FIGS. 2 to 4 may be designed to pass contacts having a maximum section of 1 mm×3 mm and to receive wires having a maximum diameter of 2.7 mm, with the passages being spaced apart at a pitch equal to 5 mm within a row and to 6 mm between rows, the rest diameter of the orifices being 1 mm when the contacts are inserted prior to installing the rigid plate.

A feedthrough of the kind shown in FIGS. 2 to 4 may be made without difficulty by molding, using longitudinal unmolding.

Figure 5:
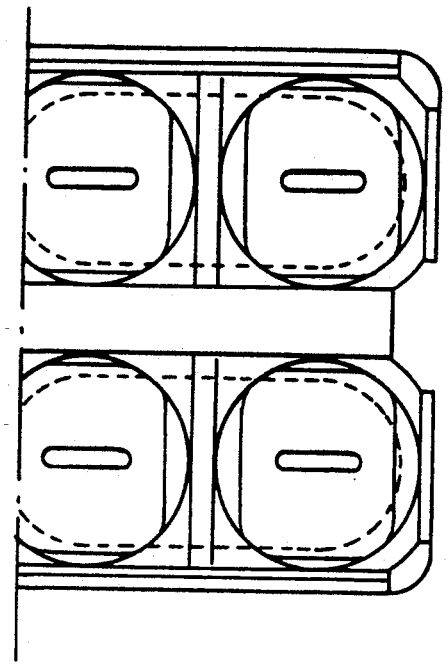
FIG. 5 is similar to FIG. 3 and shows a feedthrough constituting a variant embodiment in which the lips close the passages, even in the free state.

The variant embodiment shown in FIG. 5 differs from that of FIG. 2 practically only in the rest shape of its sealing lips: its lips define single narrow slots. This disposition is particularly advantageous for use with male contacts in the form of tongues or blades or with female contacts having a section that is in the form of an elongate rectangle.

The variant embodiment shown in FIG. 6 (where items that correspond to those already shown are given the same reference numeral plus the index a) differs from that of FIGS. 2 to 4 in that level with each lip it includes a recess 46 forming a portion of the elastomer-receiving voids. Similarly, recesses 46 are formed in the lateral faces of the feedthrough on either side of the rows. A drawback of this feedthrough (unless a central slot is left therein) is that it can be manufactured only in a mold having transverse slides.

Figure 8:
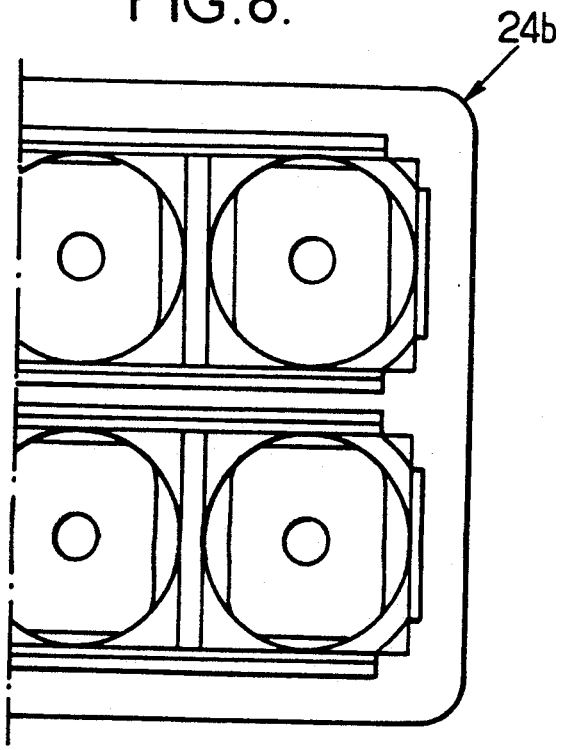
FIG. 8 is a rear view of the feedthrough of FIG. 6.
Figure 7:
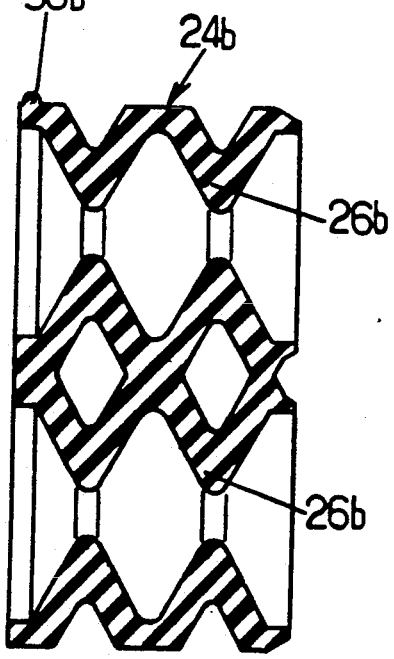

In the variant embodiment shown in FIGS. 7 and 8, the semi-circular recesses 46 and 48 of FIG. 6 are replaced by wedge-shaped recesses giving substantially constant thickness to the elastomer in a plane perpendicular to the rows.

Whereas all of the embodiments above are designed to receive contacts 16 that are all identical, the embodiment of FIGS. 9 and 10 makes it possible for the same connector to have contacts of two different widths. The feedthrough 24c shown in FIGS. 9 and 10 (where items corresponding to items described above are given the same reference numerals plus the index c) comprises two rows of three passages each. In each row, two of the passages are spaced apart at a pitch which is greater than the pitch between the second passage and the third passage which is narrower than the others. This disposition shown in FIGS. 9 and 10 can be extended to a larger number of passages in each row or to a larger number of rows. Since the width of the connector is much greater than the space occupied by the wires, the feedthrough is provided with a collar 34 which may be brought to bear against a tubular chimney extending the rigid plate.

Figure 11:
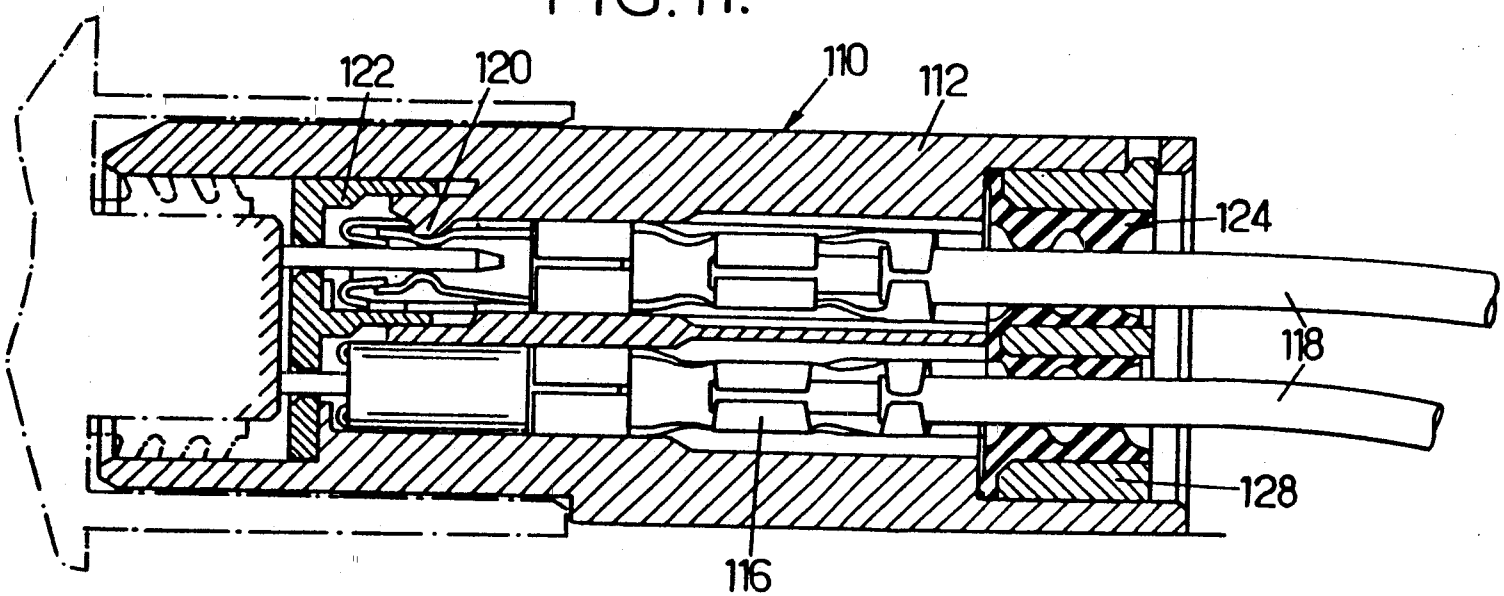
FIG. 11 is a simplified section view through a connector having two rows of contact positions, the section being on a plane orthogonal to the rows, and the connector being provided with a feedthrough comprising yet another embodiment of the invention.

The connector shown in FIG. 11 is generally similar in structure to that shown in FIG. 1 and corresponding items are designated by the same reference numerals, plus 100.

The feedthrough in the embodiment of the invention shown in FIGS. 12 to 15 is again constituted by a single piece of flexible elastomer. Each of the passages for receiving a wire is circularly symmetrical, having corrugations that constitute lips 126, there being two lips per passage in the example shown. These lips are again of height h that is considerably greater than that used in conventional feedthroughs for passages distributed at a given pitch. At rest, each lip defines an orifice of diameter d that is small enough to enable the lip to close up and provide sealing in the absence of a wire when the feedthrough is deformed by inserting a rigid plate 128 whose shape and function are described below.

A notch 130 of substantially constant thickness is formed in the elastomer in the middle of each gap between two rows of passages. To make it possible for at least some of the passages to receive wires having a diameter greater than the rest diameter d of the orifices, voids are formed in the feedthrough. In the example shown in FIGS. 12 to 15, these voids comprise firstly zones that are set back between the lips 126, and secondly broad notches 132 formed in the insulation between successive passages in the same row.

Sealing is provided between the body 112 and the feedthrough 124 by plane thrust. To this end, the feedthrough 128 includes a collar 134 designed to be pressed against a shoulder 136 of the body and provided with a circumferential lip 138 (the number one not being limiting).

Figure 13:
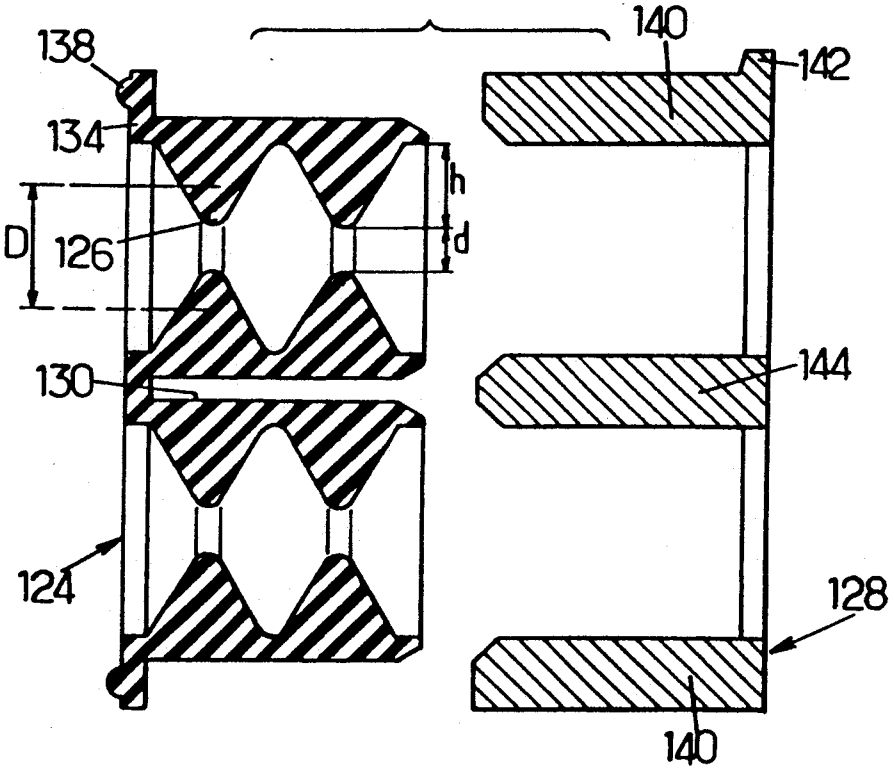
FIG. 13 shows the FIG. 12 feedthrough and an associated rigid part, in section on line XIII—XIII of FIG. 12.

On its own, the feedthrough having the shape shown in section in FIG. 13 would suffice for ensuring sealing between a feedthrough and wires of diameter greater than d. In contrast, passages having no wires would give access to pollutants. In accordance with the invention, these passages are closed on insertion into the body 112 of a rigid part 128 for pushing back the lips. This part has an end wall bearing two parallel flanks 140 for insertion on either side of the rows, between the body 112 and the feedthrough 124. The part 128 is provided with means suitable for fastening it to the body. In the example shown in FIGS. 13 and 15, these means are constituted by one or more studs 142 that snap-fasten in holes formed in the body. The holes are located so that when the part 128 is locked, it presses the rim 134 against the shoulder of the body and ensures sealing between the body and the feedthrough.

The part 128 also includes a partition 144 parallel to the flanks and designed to be inserted in each of the notches 130. The thickness of the partition is greater than the rest width of the notch 130. The flanks and the partition are of thickness in proportion to the width of the notch 130 and to the shape of the lips 126 such that the elastomer is pushed back to close the orifices in the absence of wire, as shown in the top portion of FIG. 15.

Figure 15:
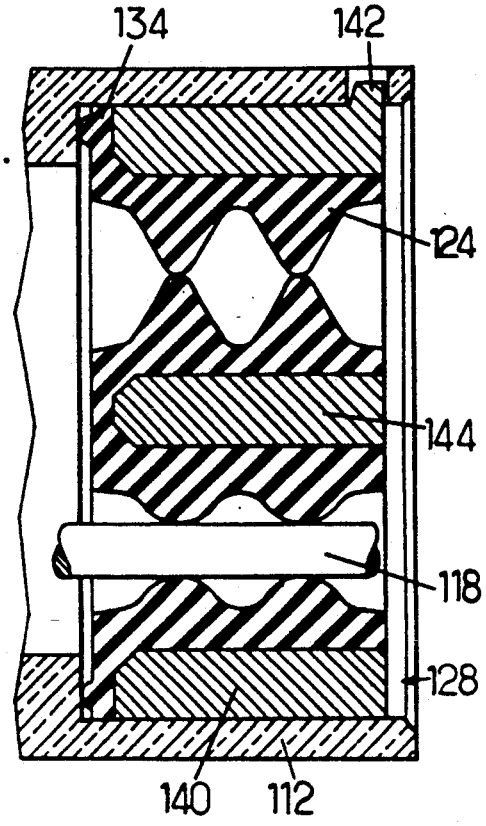
FIG. 15, similar to FIG. 13, shows the shape taken up by the feedthrough when the rigid part is inserted in the connector.

When a wire 119 is occupying a passage, the voids formed in the feedthrough make it possible for the elastomer to deform by filling the voids, thereby releasing the required section, as shown by the bottom portion of FIG. 15.

In practice, the presence of the voids or recesses makes it possible to accept wires having a diameter greater than the half-height diameter D of the lips 126, as shown in FIG. 13, but not exceeding the base diameter of the lips.

The pitch at which the passages in a single row are distributed may be equal to that commonly used in feedthroughs having lips. In contrast, it is necessary to use a spacing of slightly greater pitch between the rows.

By way of example, it may be mentioned that a feedthrough of the kind shown in FIGS. 12 to 15 may be designed to receive wires having a maximum diameter of 2.7 mm with passages distributed at a pitch equal to 5 mm within a row and equal to 6 mm between rows, and with the orifices having a rest diameter of 1 rm.

Figure 12:
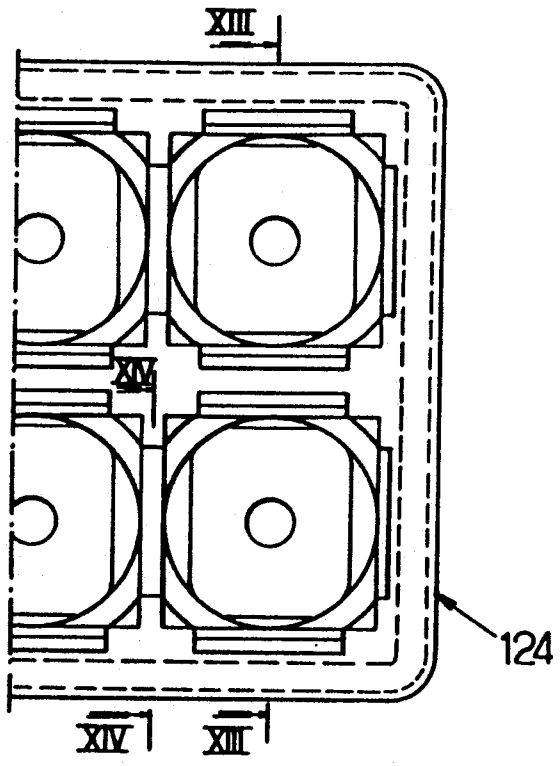
FIG. 12 is a rear view of a feedthrough constituting a particular embodiment of the invention having two rows of two passages, shown in the free state and suitable for use in the connector of FIG. 11.
Figure 14:
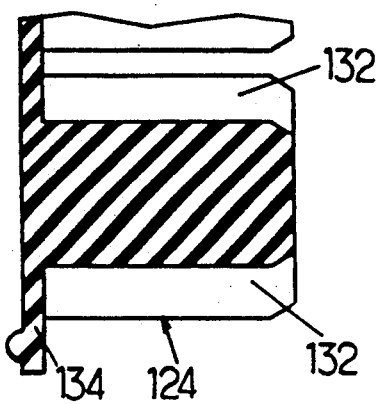
FIG. 14 shows the FIG. 12 feedthrough in section on line XIV—XIV of FIG. 12.

A feedthrough of the kind shown in FIGS. 12 to 14 can be made without difficulty by molding with longitudinal unmolding.

Figure 16:
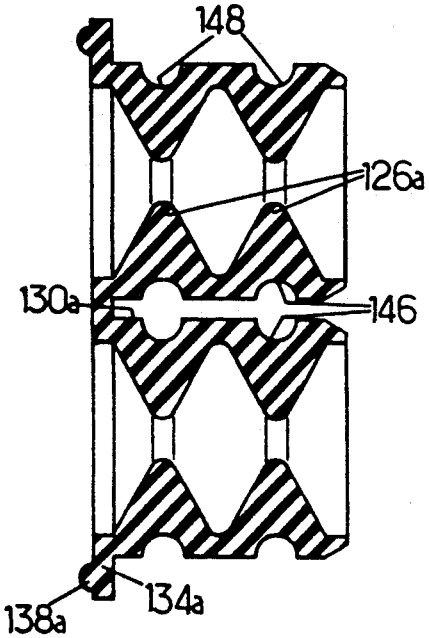

The variant embodiment shown in FIG. 16 (where items corresponding to those described above have the s&ne reference numeral plus the index a) differs from that of FIGS. 12 to 14 in that the notch 130*a* is not of constant thickness but has a recess 146 level with each lip and forming a portion of the elastomer-receiving voids. Similarly, recesses are formed in the side faces of the feedthroughs, on either side of the rows.

Figure 18:
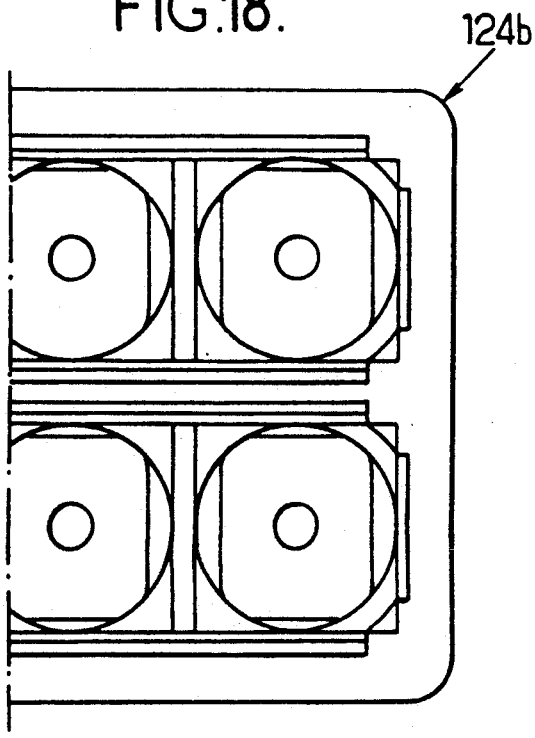
FIG. 18 is a rear view of the FIG. 16 feedthrough.
Figure 17:
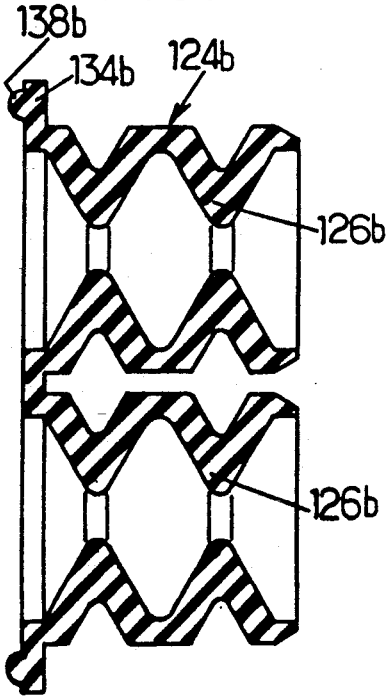
FIGS. 16 and 17 are similar to FIG. 13 and show variant embodiments of the feedthrough.

In the variant embodiment shown in FIGS. 17 and 18, the semi-circular recesses 146 and 148 of FIG. 16 are replaced by wedge-shaped recesses, giving the elastomer substantially constant thickness in a plane perpendicular to the rows.

Figure 20:
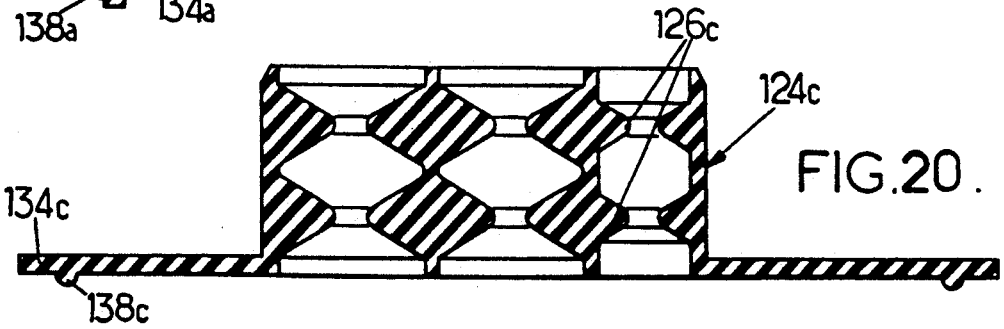
FIGS. 19 and 20, similar to FIG. 12 and in section on XX—XX, show yet another variant embodiment.
Figure 19:
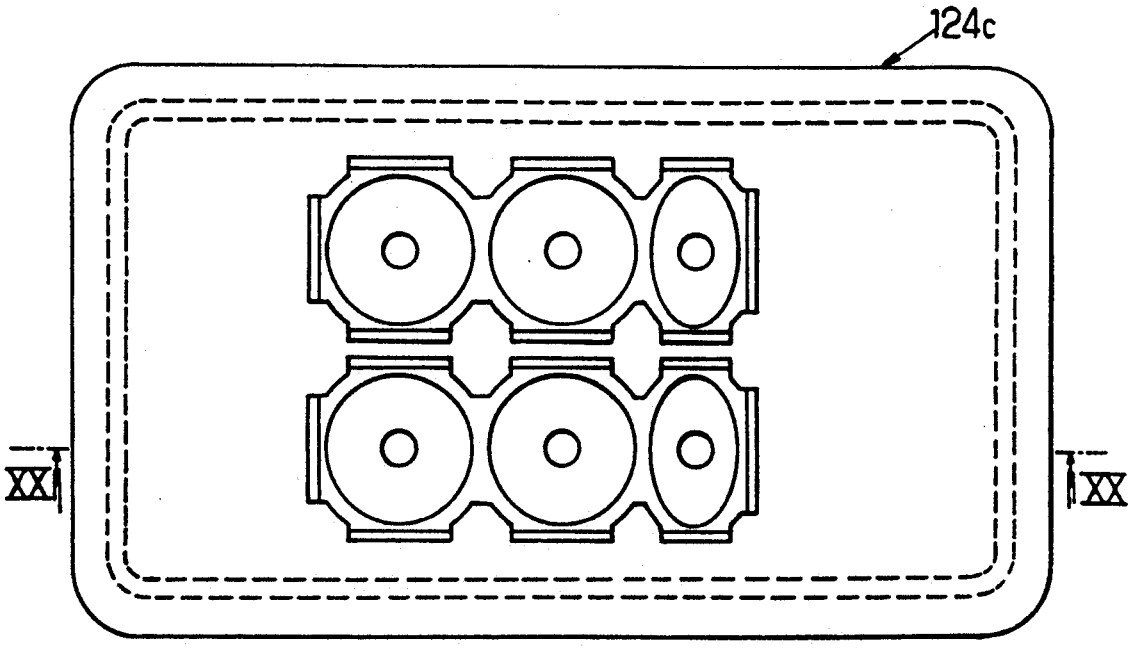

Although the embodiments described above are designed to receive contacts 116 that are all identical, the embodiment of FIGS. 19 and 20 makes it possible for a single connector to have contacts of two different widths. The feedthrough 124*c* shown in FIGS. 19 and 20 (where items corresponding to those described above are given the same reference numerals plus the index c) comprises two rows, each having three passages. In each row, two of the passages are separated by a pitch that is greater than the pitch separating the second passage from the third which is narrower than the others. This disposition shown in FIGS. 19 to 20 may be extended to a larger number of passages in each row or to a larger number of rows.

I claim:

1. An electrical connector comprising an insulating body formed with a plurality of mutually parallel passages for receiving contacts each provided with a connection wire, a rear grommet of elastomer material formed with at least two rows of individual passages for the wires of said contacts, located in alignment with said passages in said insulating body, and a plate removably connected to said body and arranged for forcing said grommet into tight contact with said body, wherein each said individual passage in said grommet includes at least one sealing lip having a shape so dimensioned that it closes the respective individual passage of said grommet, even in the absence of one said wire in the respective passage, when said grommet is held under compression against said body by said plate, the sealing lips when undeformed by said plate leaving said passages open, and wherein voids are formed in said grommet to receive elastomer material forced from zones surrounding said lips when said lips are pressed against a wire by said plate.

2. A connector according to claim 1, wherein said elastomer material has a Shore hardness of less than 40.

3. A connector according to claim 1, wherein said grommet further comprises a circumferential sealing lip located for being forcibly applied against a planar surface of a shoulder of said body which encircles all said passages in said body.

4. A connector according to claim 1, comprising fastening means for removably connecting said rigid plate to said body in a position where it applies on said grommet a compression force sufficient for said lips to close said passages in said grommet.

5. A connector according to claim 1, wherein each of said passages in said grommet has a plurality of said lips distributed along the respective passage and wherein said voids comprise zones each between two successive said lips and comprise notches formed between said rows.

6. A connector according to claim 1, wherein said voids comprise notches each formed between two successive said passages of said grommet belonging to a same one of said rows.

7. A connector according to claim 6, wherein said recesses have a shape such that the grommet has a thickness of material which is substantially constant in a plane perpendicular to the rows.

8. A connector according to claim 1, wherein said voids comprise recesses located between adjacent ones of said rows, each mid-way between two successive passages of the same one of said rows.

9. An electrical connector comprising an insulating body formed with at least two rows each of a plurality of mutually parallel passages for receiving contacts, each provided with a connection wire, a rear grommet of elastomer material formed with at least two rows of individual passages for wires of said contacts, located in alignment with said passages in said insulating body, and a plate removably fastenable to said body in a position where it retains said grommet in tight contact with said body, wherein each said passage in said grommet includes at least one sealing lip having such a shape when in an undeformed condition that the respective individual passage of said grommet is open, and wherein said plate consists of a rigid part having flanks laterally inserted on either side of said row and a partition inserted in a notch formed between the rows when said plate is fastened to said body, said flanks and partition forcing said elastomer material transversely, the thickness of the flanks being proportioned to a gap defined by said lips and to the width of the notch so as to cause the lips to close even in the absence of wires, and said grommet being formed with voids to receive the elastomer forced from zones surrounding the lips when the lips are pressed against a wire due to insertion of the rigid part.

10. A connector according to claim 9, wherein said voids comprise a plurality of recesses each formed in the wall of said notch or notches.

11. A connector according to claim 9, having a plurality of said rows, wherein said rigid part further comprises, for each additional space between two said rows, an additional said partition insertable in a notch formed in said grommet halfway between the two said rows.

* * * * *